United States Patent [19]

Siepmann

[11] Patent Number: 4,896,126

[45] Date of Patent: Jan. 23, 1990

[54] COIL FOR AN ELECTROMAGNETIC RELAY HAVING DELAYED SWITCHING

[75] Inventor: Richard Siepmann, Munich, Fed. Rep. of Germany

[73] Assignee: Siemens Aktiengesellschaft, Berlin and Munich, Fed. Rep. of Germany

[21] Appl. No.: 289,058

[22] Filed: Dec. 23, 1988

[30] Foreign Application Priority Data

Feb. 17, 1988 [DE] Fed. Rep. of Germany ... 8802045[U]

[51] Int. Cl.[4] ..... H01F 7/10

[52] U.S. Cl. ..... 335/244; 335/250

[58] Field of Search ..... 335/243, 244, 245, 246, 335/250, 230

[56] References Cited

U.S. PATENT DOCUMENTS 1,789,417 1/1931 Shepard ..... 335/244

1,809,634 6/1931 Lazich ..... 335/230

1,979,709 11/1934 Schaelchlin et al. ..... 335/244 X 3,421,127 1/1969 Fischer et al. ..... 336/208

4,302,743 11/1981 Araki ..... 335/244 X

*Primary Examiner*—George Harris

*Attorney, Agent, or Firm*—Hill, Van Santen, Steadman & Simpson

[57] ABSTRACT

In a coil for an electromagnetic relay, a delayed response is achieved by a short-circuit tube which carries the coil member and replaces a plastic tube which is otherwise used. The short-circuit tube is extrusion coated at its ends with the coil flanges so and a thin insulating layer is provided on the short-circuit tube under the winding in the region between the flanges. The dimensions of the winding and the core are not increased while a considerable delayed response for the relay is provided.

11 Claims, 1 Drawing Sheet

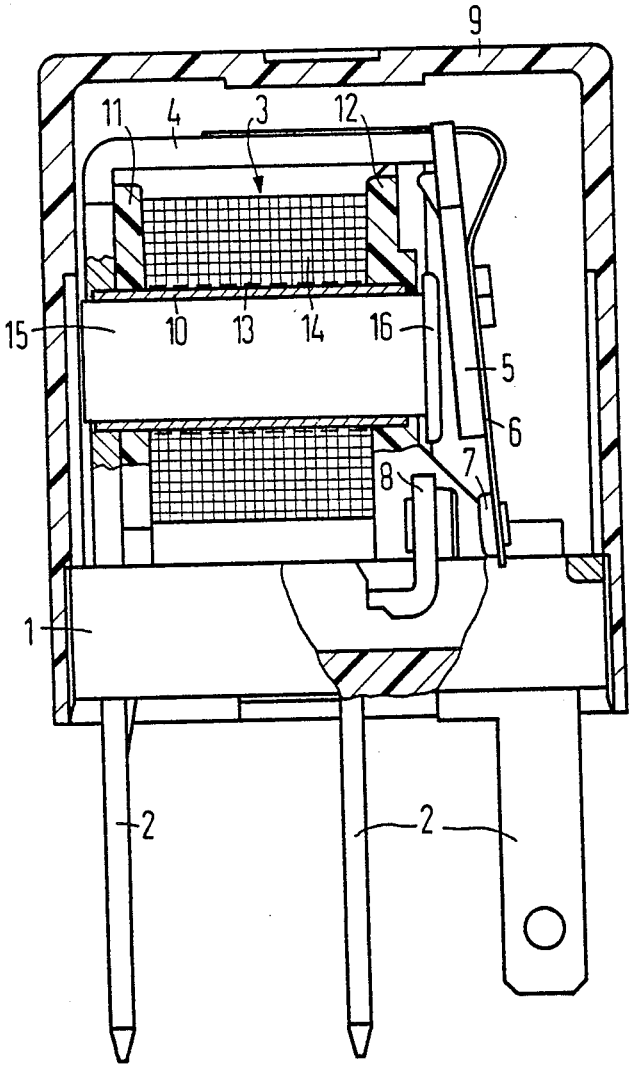
9
11
4
3
12
15
10
13
14
16
5
6
7
8
1
2
2

COIL FOR AN ELECTROMAGNETIC RELAY HAVING DELAYED SWITCHING

BACKGROUND OF THE INVENTION

1. Field of the Invention

The present invention is directed generally to a coil member for an electromagnetic relay having a delayed response. More particularly, the coil member includes a coil tube for accepting a core as well as two flanges connected thereto at the ends of the coil tube. A winding is applied on the coil tube between the flanges.

2. Description of the Related Art

When a chattering drive signal is applied to relays such as due to poor switches in motor vehicles, there is a risk that quickly responding relays will go along with the chattering signal of these drive switches. This results in the contacts of the relays being repeatedly switched on and off until they remain closed. Such on and off switching leads to greater contact wear and may lead to welding of the contact elements when the switch loads carried by the closed contacts have high currents. If the delayed response of the relay were to be delayed so that the closing of the contacts occurred after the chattering of the drive signal chattering, the problem would be solved, at least in part.

It is already known to achieve a delayed response in a relay by providing a short circuit ring or by providing a solid short-circuit tube of copper. In the known arrangements having these features, however, the usable winding space is reduced by the volume of the short-circuit tube. When a winding space of a fixed size is provided, the excitation power required for the relay is increased.

A coil of the type discussed above which includes a short-circuit tube of copper is disclosed, for example, in German published application No. 15 14 717 and corresponding U.S. Pat. No. 3,421,127, incorporated herein by reference. It is proposed therein that the coil member be formed in multiple parts and be joinable by first slipping a copper tube onto the core tube of the coil member and then connecting the flange to the core tube. This, however, results in not only an increased expense for the parts and manufacturing steps but the winding space is reduced in size by the addition of the copper tube.

SUMMARY OF THE INVENTION

An object of the invention is to provide a delayed response in a relay with a short-circuit tube without modifying the winding space or other dimensions of the coil of the relay as a result.

This and other objects are inventively achieved in that the short-circuit tube forms the carrying part of the coil tube and has its ends connected to the insulating material of the flanges. Only a thin insulating layer is provided between the short-circuit tube and the winding in the region between the flanges.

In the coil of the present invention, thus, a short-circuit tube of copper or of a comparable material represents the bearing element of the coil member. This tube replaces the coil tube of plastic which is electrically inactive and which is normally present in coil members. The winding space or the cross section size of the relay are thereby not modified. As a result of the small diameter obtainable in this way, and as a result of the length of the short-circuit tube over the entire region between the coil flanges, an AR value (which is the value of the resistance of the short-circuit winding) is achieved on the order of magnitude of the excitation winding for the short-circuit tube. In comparison, delayed responses of up to double those of the coil without the short-circuit tube can be achieved therewith.

In an advantageous development, the short-circuit tube is enveloped at its ends by embedding in the material of the coil flanges such as by injection. An interference fit between the short-circuit tube and the flanges can also be provided with an appropriate surface design in this region. For example, the short-circuit tube can be knurled.

The insulation between the winding and the copper tube is, for example, a thin skin of the same plastic as the flange which is sprayed on the short-circuit tube before application of the winding wire to provide an insulating layer. Further possibilities include wrapping the short-circuit tube with a plastic film or lacquering the short-circuit tube.

BRIEF DESCRIPTION OF THE DRAWING

The drawing FIGURE shows an exemplary embodiment of the relay according to the present invention in side view and partially in cross section.

DESCRIPTION OF THE PREFERRED EMBODIMENTS

In the FIGURE is shown a relay for switching high currents, the relay being used, for example, in motor vehicles. The critical component parts of the relay include a pedestal 1 having a flat plug 2 and a coil 3 that is secured in the pedestal 1 and serves as a base member for the overall relay system. A yoke 4 including an armature 5 as well as a contact spring 6 are arranged on the coil 3. The contact spring 6 also serves as the armature restoring spring. A contact piece 7 is mounted at a free end of the spring 6 to cooperate with a cooperating contact element 8 anchored in the pedestal 1. Together with the pedestal 1, a cap 9 forms a closed and sealable housing. In this regard, the illustrated relay is constructed in the known form.

The coil 3 includes a coil tube in the form of a short-circuit tube 10 made of copper. The ends of the short-circuit tube 10 are extrusion coated with flanges 11 and 12. Other materials having good electrical conductivity, such as copper alloys or aluminum, may also be used in place of the copper to form the short-circuit tube 10. Only a thin insulating layer 13 (shown as dashed lines) which is sprayed on as a thin skin or is subsequently applied as a foil or film is provided in the region between the two flanges 11 and 12. A winding 14 is applied thereover in a standard fashion.

A core 15 is inserted into the coil tube 10 in a way that is likewise standard, the core 15 having one end connected to the yoke 4 and forming a pole plate 16 for the armature 5 at the other end.

Thus, there is provided a coil for an electromagnetic relay which achieves a delayed response as the result of the short-circuit tube 10 and eliminates the need for a plastic tube which is otherwise used. A considerably delayed response for the relay is provided without changing the dimensions of the winding or of the core.

Although other modifications and changes may be suggested by those skilled in the art, it is the intention of the inventor to embody within the patent warranted hereon all changes and modifications as reasonably and properly come within the scope of his contribution to the art.

I claim:

1. A coil for an electromagnetic relay having a delayed response, comprising:

a coil member having:

a core;

a coil tube immediately over said core, a carrying part of said coil tube being a short-circuit tube of a material of good electrical conductivity;

two flanges being at least partly of an insulating material connected at ends of said coil tube;

only a thin insulating layer provided over said short-circuit tube in a region between said two flanges; and a winding applied over said thin insulating layer on said short-circuit tube between said two flanges.

2. A coil as claimed in claim 1, wherein said short-circuit tube is enveloped with said insulating material of said two flange at its ends by embedding.

3. A coil as claimed in claim 2, wherein the ends of said short-circuit tube are extrusion coated with said insulating material of said two flanges.

4. A coil as claimed in claim 2, wherein said short-circuit tube has a rough surface in the regions of said two flanges.

5. A coil as claimed in claim 4, wherein said rough surface is knurled.

6. A coil as claimed in claim 1, wherein said thin insulating layer is a thin sprayed skin over said short-circuit tube in the region between said two flanges.

7. A coil as claimed in claim 1, wherein said thin insulating layer is an insulating foil wrapped about said short-circuit tube in a region between said flanges.

8. A coil as claimed in claim 1, wherein said thin insulating layer is an insulating lacquer layer covering said short-circuit tube in a region between said two flanges.

9. A coil as claimed in claim 1, wherein said coil member is mounted in an electromagnetic relay.

10. An improved relay for delayed response including a coil about a core, a yoke mounted about the coil and supporting an armature restoring spring which biases an armature, the improvement comprising:

a short-circuit tube of an electrically conductive material provided directly about the core between the core and the coil, said short-circuit tube causing a delayed response of the armature upon energization of the coil; and a thin insulating layer over said short-circuit tube between said short-circuit tube and the coil.

11. An improved relay for delayed response including a coil about a core, a yoke mounted about the coil and supporting an armature restoring spring which biases an armature, the improvement comprising:

a short-circuit tube of an electrically conductive marterial provided directly about the core between the core and the coil, said short-circuit tube causing a delayed response of the armature upon energization of the coil; and first and second flanges mounted directly on opposite ends of said short-circuit tube, said first and second flanges being of an insulating material.

* * * * *